US005799803A

United States Patent [19]

Müller

[11] Patent Number: 5,799,803

[45] Date of Patent: Sep. 1, 1998

[54] CANTILEVERED SHELF AND SHELF BRACKET

[75] Inventor: Mark Müller, Uxbridge, Canada

[73] Assignee: Nienkamper Furniture & Accessories Inc., Toronto, Canada

[21] Appl. No.: 805,640

[22] Filed: Feb. 26, 1997

[51] Int. Cl.[6] ..... A47F 5/00

[52] U.S. Cl. ..... 211/90.01; 108/108; 108/152; 248/250

[58] Field of Search ..... 211/90.01, 90.04, 211/187; 248/235, 250; 108/152, 108

[56] References Cited

U.S. PATENT DOCUMENTS

| | | | |
|---|---|---|---|
| 3,110,934 | 11/1963 | Triplett | 211/90.01 X |
| 3,381,636 | 5/1968 | Saiberlich | 211/90.01 X |
| 4,037,813 | 7/1977 | Loui et al. | 248/250 |
| 4,429,850 | 2/1984 | Weber et al. | 108/108 X |
| 4,765,575 | 8/1988 | Bergl et al. | 248/250 |
| 4,821,892 | 4/1989 | Randall | 211/90.01 |
| 4,871,136 | 10/1989 | Bessinger et al. | 211/90.01 X |
| 4,934,642 | 6/1990 | Baron et al. | 211/90.01 X |
| 5,384,198 | 1/1995 | Hodges | 248/235 X |
| 5,485,933 | 1/1996 | Crooymans | 211/90.04 |

*Primary Examiner*—Robert W. Gibson, Jr.

[57] ABSTRACT

A cantilevered shelf system includes a shelf bracket having an upper jaw, a lower jaw extending beyond the upper jaw and a back plate adjoining the upper jaw and the lower jaw, and a shelf having a top face with an engaging surface which contacts the upper jaw as the shelf is mounted into the bracket. The shelf has a bottom face with a rear cam edge and a longitudinal groove forwardly of the cam edge for insertion of a projection on the lower jaw. The distance between the cam edge and the engaging surface is slightly greater than the distance between the upper jaw and the lower jaw, so that the cam edge splays the jaws apart as the shelf is being mounted and the shelf snaps into a mounted position in which the projection is seated in the groove. When the shelf is fully mounted the cam edge resists upward displacement of the shelf and the projection prevents forward displacement of the shelf.

20 Claims, 4 Drawing Sheets

CANTILEVERED SHELF AND SHELF BRACKET

FIELD OF INVENTION

This invention relates to shelving systems. In particular, this invention relates to a cantilevered shelf system comprising a shelf and a shelf bracket for mounting the shelf on a wall, panel or other structure, in which the shelf locks into the bracket without the need for additional hardware.

BACKGROUND OF THE INVENTION

Wall-mounted shelving, shelving units and the like are used for storing and displaying articles in such applications as merchandising, home and commercial furnishing and storage. It is advantageous in such systems to provide shelves which are adjustable in height. For example, one of the most common shelving systems uses the slotted standard, which is essentially a metal channel with a main face having a column of vertical slots. Various shapes and styles of brackets provided with barbed flanges mount into selected positions in the standard, and the shelves are in turn mounted on the brackets. Other systems incorporate self-standing shelving structures, such as wall units, book cases and the like with adjustable shelf support pegs.

Such shelving systems are often conspicuous and unattractive. Decorative display and shelving units in particular are designed primarily for aesthetics, and the presence of visible hardware can significantly detract from visual appeal. Moreover, in shelving units the shelves are confined by the extremities of the unit, which restricts the length and positioning of the shelves.

In many shelving systems the shelves are merely seated on supporting hardware, without any locking engagement to the hardware, which can result in inadvertent dislodgement or upsetting of a shelf and consequent spillage, and possibly breakage, of its contents. Additionally, most such systems require some degree of assembly, which usually involves a number of small parts that can be lost or damaged.

SUMMARY OF THE INVENTION

The present invention overcomes these disadvantages by providing a wall-mounted shelf system which is attractive, with virtually no visible hardware; versatile in terms of the number, positioning and lengths of shelves; and which provides a locking engagement between the shelf and the shelf bracket to resist inadvertent dislodgement of a shelf without requiring any additional hardware.

The invention accomplishes this by providing a shelf bracket which mounts to a wall or other supporting panel or structure and supports a shelf in cantilevered fashion. The shelf is configured to snap into the shelf bracket with a camming action, so that the system provides a locking engagement between the shelf and the shelf bracket. The length of each shelf can be selected as desired, and since each shelf is mounted independently of other shelves there is considerable versatility in the number and positioning of shelves that can be mounted for both functional and decorative purposes.

The present invention thus provides a cantilevered shelf system comprising a shelf bracket having an upper jaw, a lower jaw projecting beyond the upper jaw and having a top face with at least one projection, and a back plate adjoining the upper jaw and the lower jaw in substantially fixed spaced relation, and a shelf having a top face having a supporting surface and an engaging surface which contacts the upper jaw as the shelf is mounted into the bracket, and a bottom face having a rear cam edge, the bottom face being provided with a recess forwardly of the cam edge for insertion of the at least one projection, and a spacing between the engaging surface and the bottom face which is substantially the same as a spacing between the upper jaw and the lower jaw, wherein a distance between the cam edge and the engaging surface is slightly greater than the spacing between the lower jaw and the upper jaw, such that the cam edge applies a force against the lower jaw as the shelf is being mounted into the bracket and the force is released as the shelf is mounted into a mounted position in which the at least one projection is seated in the recess.

The present invention further provides, in combination, a shelf bracket having an upper jaw, a lower jaw projecting beyond the upper jaw and having a top face with at least one projection, and a back plate adjoining the upper jaw and the lower jaw in substantially fixed spaced relation, and a shelf having a top face having a supporting surface and an engaging surface which contacts the upper jaw as the shelf is mounted into the bracket, and a bottom face having a rear cam edge, the bottom face being provided with a recess forwardly of the cam edge for insertion of the at least one projection, and a spacing between the engaging surface and the bottom face which is substantially the same as a spacing between the upper jaw and the lower jaw, wherein a distance between the cam edge and the engaging surface is slightly greater than the spacing between the lower jaw and the upper jaw, such that the cam edge applies a force against the lower jaw as the shelf is being mounted into the bracket and the force is released as the shelf is mounted into a mounted position in which the at least one projection is seated in the recess.

The present invention further provides a shelf bracket for a cantilevered shelf system comprising a shelf having a top face having a supporting surface and an engaging surface and a bottom face having a rear cam edge, the bottom face being provided with a recess forwardly of the cam edge for insertion of a projection, the shelf bracket comprising an upper jaw, a lower jaw extending beyond the upper jaw and having a top face with at least one projection, and a back plate adjoining the upper jaw and the lower jaw in substantially fixed spaced relation, wherein a distance between the cam edge and the engaging surface is slightly greater than the spacing between the lower jaw and the upper jaw, such that the cam edge applies a force against the lower jaw as the shelf is being mounted into the bracket and the force is released as the shelf is mounted into a mounted position in which the at least one projection is seated in the recess.

BRIEF DESCRIPTION OF THE DRAWINGS

In drawings which illustrate by way of example only a preferred embodiment of the invention.

DETAILED DESCRIPTION OF THE INVENTION

Figure 1:
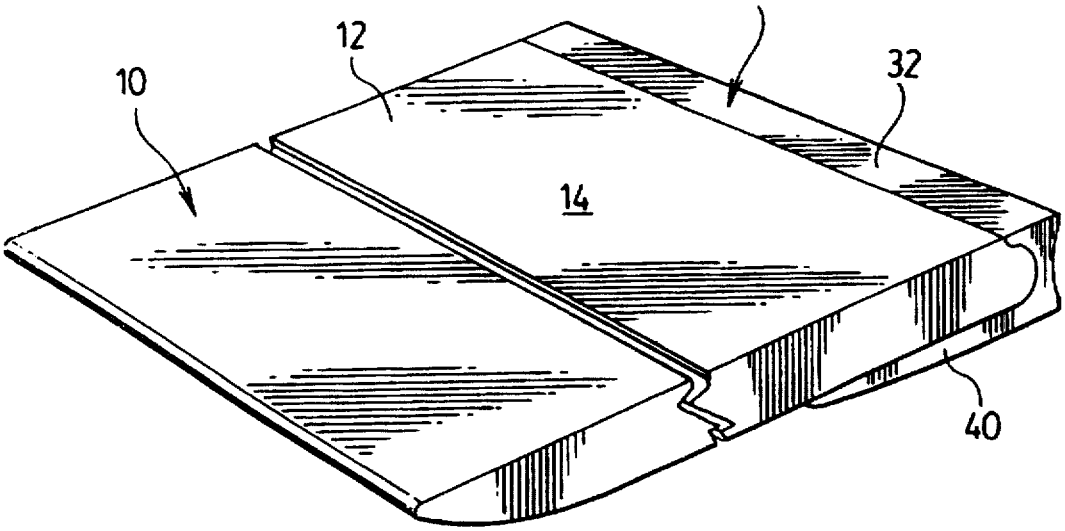
FIG. 1 is a perspective view of the cantilevered shelf system of the invention.

The present invention provides a cantilevered shelf system, illustrated in FIG. 1, comprising a shelf 10 and a shelf bracket 30. The shelf 10 in the preferred embodiment is constructed from a medium density fibreboard with a wood veneer finish, however the shelf 10 can be made from wood, particle board, plastic or metal, so long as the shelf has a suitable thickness. Wood shelves have been found to be particularly suitable for the shelf system of the invention, but the invention is not intended to be limited by the choice of material for the shelf 10. The shelf bracket 30 is preferably extruded from a metal such as aluminum or a strong, substantially rigid plastic such as ABS or PVC.

Figure 4:
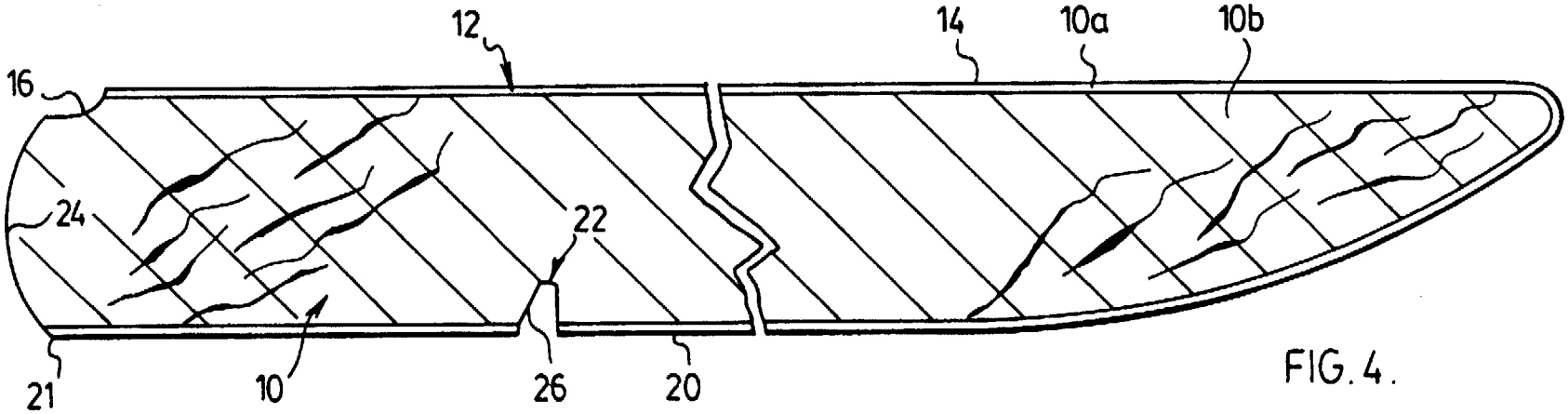
FIG. 4 is a cross-sectional view of a shelf for the system of FIG. 1.

In the preferred embodiment the shelf 10 has a top face 12 with a supporting surface 14 and an engaging surface 16, best seen in FIG. 4, and a bottom face 20 with a rear cam edge 21. The bottom face 20 is also provided with a recess, which in the preferred embodiment is a groove 22 extending longitudinally along the length of the shelf 10 having a rear wall 26 sloping away from the rear face 24 of the shelf 10.

Figure 2:
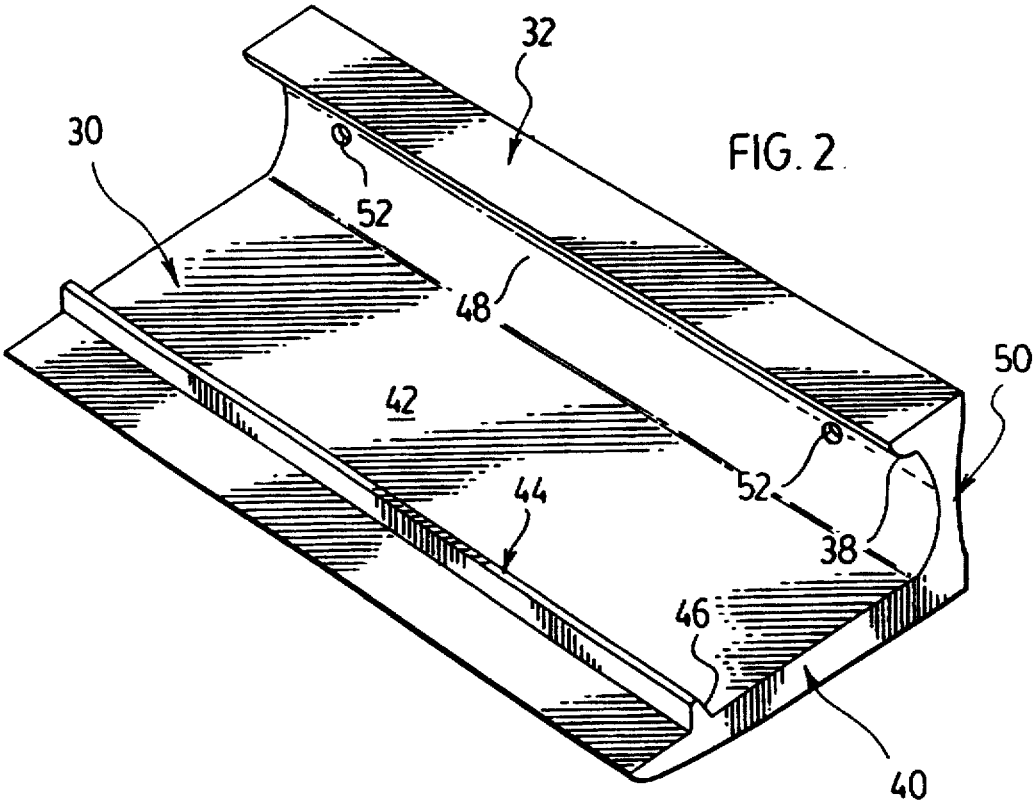
FIG. 2 is a perspective view of the shelf bracket for the system of FIG. 1.
Figure 3:
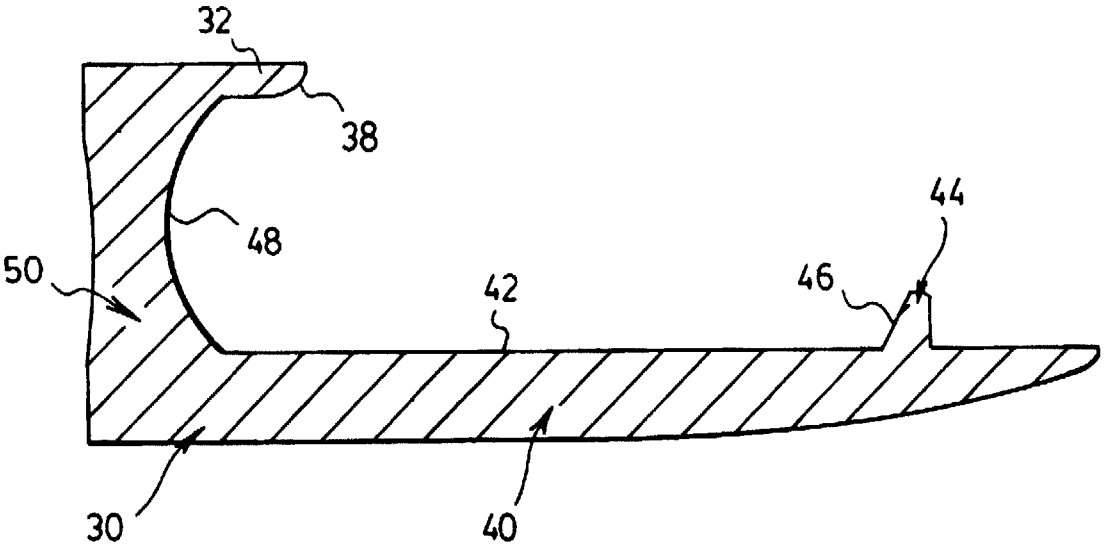
FIG. 3 is a cross-sectional view of the shelf bracket of FIG. 2.

A preferred embodiment of the shelf bracket 30 is illustrated in FIGS. 2 and 3. The bracket 30 comprises an upper jaw 32; a lower jaw 40 which projects beyond the upper jaw 32 and has a top face 42 with a projection 44; and a back plate 50 adjoining the top jaw 32 and the bottom jaw 40 in fixed relation. The back plate 50 is provided with holes 52 at suitably spaced intervals to mount the shelf 10 on a wall, panel or other such surface using conventional fasteners such as screws, bolts, etc. (not shown).

Figure 6:
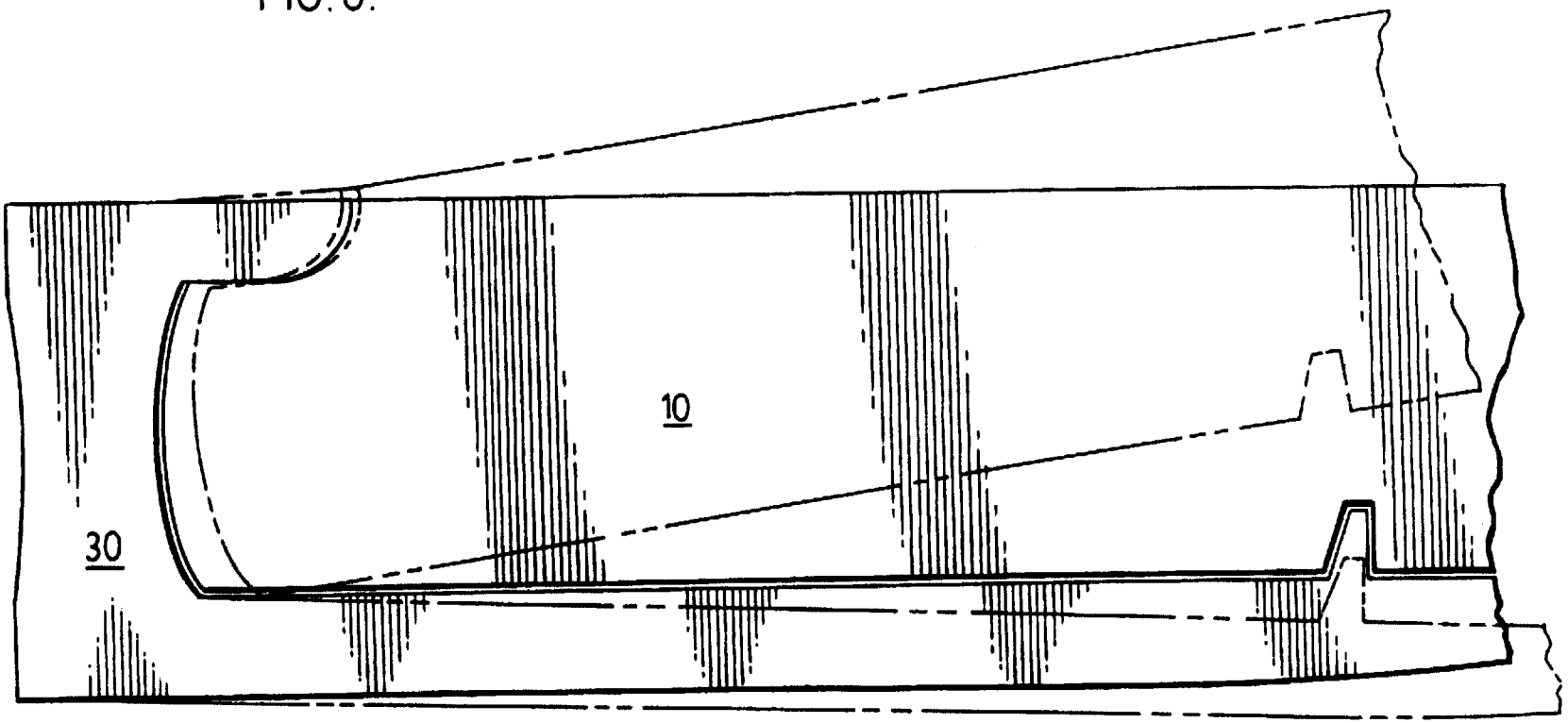
FIG. 6 is an enlarged partial side elevation showing the camming action of the shelf against the bracket during the mounting process.

The shelf 10 cooperates with the shelf bracket 30 to lock the mounted shelf 10 into the bracket 30. The distance between the rear cam edge 21 of the shelf 10 and the engaging surface 16 is slightly greater than the spacing between the upper jaw 32 and the lower jaw 40, which in the preferred embodiment is 1 1/16 inches (to snugly accommodate a 1 inch thick shelf core 10*a* with 1/32 inch veneer 10*b* on its top and bottom faces). As can be seen in FIG. 6, this provides a camming action as the shelf 10 is being mounted into the bracket 30. This camming action may involve a small degree of resilient compression of the cam edge 21, but primarily involves slight splaying of the upper and lower jaws 32, 40 as the cam edge 21 applies a force against the lower jaw 40 during mounting, which force is released as the shelf 10 snaps into the fully mounted position and the jaws 32, 40 return to their rest position. It will thus be appreciated that although the bracket 30 is formed from a substantially rigid material, it must have a slight resilience in order for the system of the invention to operate properly; a completely rigid shelf bracket 30 (for example made of cast iron) would probably not flex sufficiently to permit the shelf 10 to be mounted without deforming the cam edge 21.

The upper jaw 32 preferably has a transversely convex surface 38 along which the engaging surface 16 of the shelf 10 slides as the shelf 10 is mounted into the bracket 30. In the preferred embodiment the convex surface 38 extends almost from the top of the upper jaw 32, to maximize the radius of curvature and thus minimize resistance to mounting. As the radius of curvature of the convex surface 38 is reduced it becomes more difficult to mount the shelf 10, particularly if the shelf 10 is made of a rough-surfaced material such as wood.

In the preferred embodiment the engaging surface 16 is recessed from the supporting surface 14, and preferably concavely curvate to match the profile of the convex surface 38. In this embodiment the supporting surface 14 is flush with the top of the bracket 30 when the shelf 10 is fully mounted, which enhances the aesthetic appeal of the system and gripping of the shelf 10 by the jaws 32, 40.

The mounted shelf 10 is restrained from forward displacement by cooperation between the projection 44 and the groove 22. The projection 44 extends into the space between the upper and lower jaws 32, 40 and thus projects into the groove 22 when the shelf 10 is fully mounted.

In the preferred embodiment the projection 44 extends longitudinally along the entire length of the bracket 30 and has a rear wall 46 sloping away from the back plate 50, at an angle complimentary to the slope of the rear wall 26 of the groove 22 in the shelf 10. It will be appreciated that one or more smaller projections would also function to prevent forward displacement of the shelf 10, and the groove 22 could in such an embodiment be replaced with smaller recesses. However, this embodiment could be more expensive to produce and could give rise to alignment problems during mounting, one of the advantages of the preferred embodiment being that the shelf 10 and bracket 30 can be manufactured in standard lengths and cut on site to the desired size without regard for lateral (ie. side-to-side) alignment and without detracting from resistance to dislodgement.

In the preferred embodiment the rear face 24 of the shelf 10 is convex in cross-section, and the front face 48 of the back plate 50 has a complimentary concave profile. The projection 44 is thus preferably spaced from the front face 48 of the back plate 50 substantially the same distance as the groove 22 is spaced from the rear face 24 of the shelf 10. This allows the shelf 10 to seat snugly against the back plate 50 when fully mounted in the bracket 30, which provides a particularly secure engagement between the shelf 10 and the bracket 30. (In the preferred embodiment the holes 52 are countersunk, to accommodate the screws or other fasteners without interfering with the mounting of the shelf 10 into the bracket 30.)

The rear face of the back plate 50 may be formed with a slight concavity as shown, to accommodate imperfections in the wall or panel upon which the bracket 30 is mounted. However, the back plate 50 should be thick enough to resist deformation if the screws or other fasteners are overtightened; otherwise the upper and lower jaws 32, 40 might be forced out of alignment which could reduce the effectiveness of the camming action of the shelf 10 or make it difficult to mount the shelf 10.

Figure 5A:
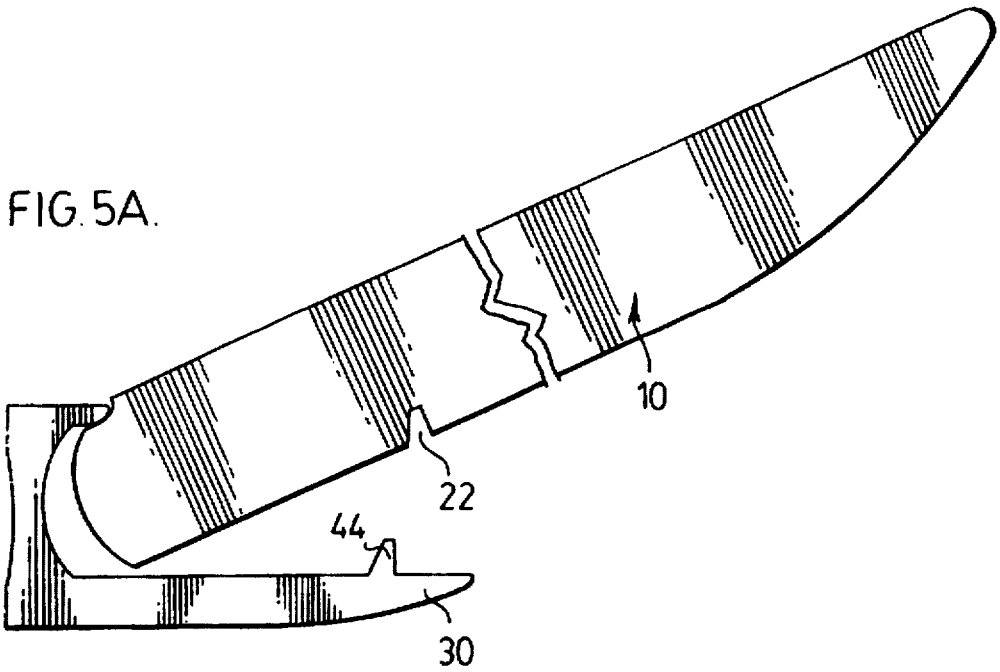
FIG. 5*a* is a side elevation of the shelf of FIG. 4 in position for mounting into the shelf bracket of FIG. 2.
Figure 5B:
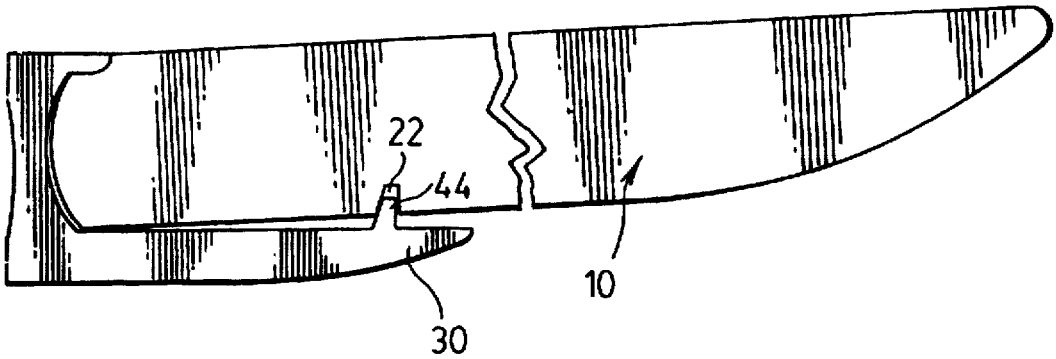
FIG. 5*b* is a side elevation of the shelf of FIG. 4 partially mounted into the shelf bracket of FIG. 2.
Figure 5C:
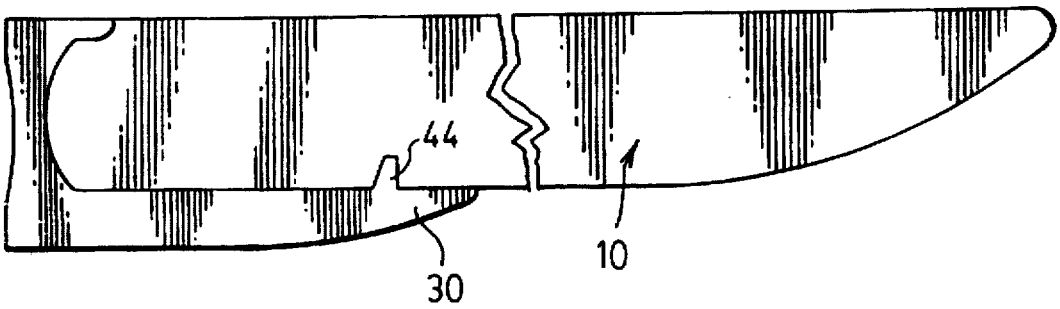
FIG. 5*c* is a side elevation of the shelf of FIG. 4 fully mounted into the shelf bracket of FIG. 2.

In operation, the installer cuts a shelf 10 and shelf bracket 30 to length, and fastens the shelf bracket 30 to a wall, panel or other supporting structure using conventional fasteners (not shown) disposed through the holes 52 in the back plate 50. The installer mounts the rear end of the shelf 10 into the bracket 30, as in FIG. 5*a*, and lowers the front end of the shelf 10 until it resists further descent (as the cam edge 21 starts to apply pressure on the lower jaw 40—see FIG. 5*b*). The installer then applies a sharp downward force to the front end of the shelf 10, to depress the shelf 10 into the fully mounted position, shown in FIG. 5*c*.

When the shelf 10 reaches the position at which the cam edge 21 starts to apply pressure on the lower jaw 40, the upper jaw 32 acts as a fulcrum so that the weight of the installer on the end of the shelf 10 causes the jaws 32, 40 to splay apart slightly and forces the cam edge 21 past dead centre, at which point the shelf 10 snaps into the mounted position. This effect is illustrated in FIG. 6 (exaggerated for purposes of illustration), with orientations of the shelf 10 and jaws 32, 40 in the fully mounted position shown in solid lines, and in the partially mounted position (cam edge 21 near dead center) shown in phantom lines.

Because in the preferred embodiment the rear face 46 of the projection 44 is sloped away from the back plate 50, as the shelf 10 is depressed to the fully mounted position the action of the bottom-rear edge of the groove 22 sliding along the sloping rear face 46 of the projection 44 (see FIG. 5*b*) also has a camming effect which forces the shelf 10 rearwardly against the back plate 50, to snugly seat the shelf 10 in the bracket 30.

In the mounted position the projection 44 is seated in the groove 22 with its rear wall 48 flush against the rear wall 26 of the groove 22, which prevents forward displacement of the shelf 10. At the same time, the jaws 32, 40 having returned to their rest position, the cam edge 21 resists upward displacement of the shelf 10 thereby maintaining the bottom face 20 of the shelf 10 flush against the top face 42 of the bottom jaw 40 and consequently retaining the projection 44 in the groove 22. This synergy between the camming action of the shelf 10 resisting upward displacement and the projection 44 resisting forward displacement renders it unnecessary to use additional hardware to secure the shelf 10 to the bracket 30.

A preferred embodiment of the invention having been thus described by way of example only, it will be apparent to those skilled in the art that certain modifications and adaptations may be made without departing from the scope of the invention, as set out in the appended claims.

I claim:

1. A cantilevered shelf system comprising a shelf bracket having an upper jaw, a lower jaw extending beyond the upper jaw, and at least one projection projecting into a space between the upper and lower jaws, and a back plate adjoining the upper jaw and the lower jaw in substantially fixed spaced relation, and a shelf having a top face having a supporting surface and an engaging surface which contacts the upper jaw as the shelf is mounted into the bracket, and a bottom face having a rear cam edge, the bottom face being provided with a recess forwardly of the cam edge for insertion of the at least one projection, and a spacing between the engaging surface and the bottom face which is substantially the same as a spacing between the upper jaw and the lower jaw, wherein a distance between the cam edge and the engaging surface is slightly greater than the spacing between the lower jaw and the upper jaw, such that the cam edge applies a force against the lower jaw as the shelf is being mounted into the bracket and the force is released as the shelf is mounted into a mounted position in which the at least one projection is seated in the recess.

2. The cantilevered shelf system of claim 1 in which the upper jaw has a transversely convex surface extending between a front face and a bottom face.

3. The cantilevered shelf system of claim 2 in which the engaging surface is recessed from the supporting surface.

4. The cantilevered shelf system of claim 3 in which the engaging surface has a curvate profile complimentary to the convex surface of the upper jaw.

5. The cantilevered shelf system of claim 1 in which the projection projects from a top surface of the lower jaw.

6. The cantilevered shelf system of claim 5 in which the projection has a rear face sloping away from the back plate.

7. The cantilevered shelf system of claim 6 in which the groove has a sloping rear face complimentary to the rear face of the projection.

8. The cantilevered shelf system of claim 6 in which the projection extends substantially along the length of the shelf bracket.

9. The cantilevered shelf system of claim 1 in which the back plate has a concave front surface and the shelf has a convex rear surface complimentary to the front surface of the back plate.

10. The cantilevered shelf system of claim 9 in which the projection is spaced from the back plate substantially the same distance as the groove is spaced from the rear face of the shelf.

11. In combination, a shelf bracket having an upper jaw, a lower jaw extending beyond the upper jaw, and at least one projection projecting into a space between the upper and lower jaws, and a back plate adjoining the upper jaw and the lower jaw in substantially fixed spaced relation, and a shelf having a top face having a supporting surface and an engaging surface which contacts the upper jaw as the shelf is mounted into the bracket, and a bottom face having a rear cam edge, the bottom face being provided with a recess forwardly of the cam edge for insertion of the at least one projection, and a spacing between the engaging surface and the bottom face which is substantially the same as a spacing between the upper jaw and the lower jaw, wherein a distance between the cam edge and the engaging surface is slightly greater than the spacing between the lower jaw and the upper jaw, such that the cam edge applies a force against the lower jaw as the shelf is being mounted into the bracket and the force is released as the shelf is mounted into a mounted position in which the at least one projection is seated in the recess.

12. The combination of claim 11 in which the upper jaw has a transversely convex surface extending between a front face and a bottom face.

13. The combination of claim 12 in which the engaging surface is recessed from the supporting surface.

14. The combination of claim 13 in which the engaging surface has a curvate profile complimentary to the convex surface of the upper jaw.

15. The combination of claim 11 in which the projection projects from a top surface of the lower jaw.

16. The cantilevered shelf system of claim 15 in which the projection has a rear face sloping away from the back plate.

17. The combination of claim 16 in which the groove has a sloping rear face complimentary to the rear face of the projection.

18. The combination of claim 17 in which the projection extends substantially along the length of the shelf bracket.

19. The combination of claim 11 in which the back plate has a concave front surface and the shelf has a convex rear surface complimentary to the front surface of the back plate.

20. The combination of claim 19 in which the projection is spaced from the back plate substantially the same distance as the groove is spaced from the rear face of the shelf.

* * * * *